United States Patent [19]

Tringali

[11] Patent Number: 4,555,878

[45] Date of Patent: Dec. 3, 1985

[54] STRUCTURAL ELEMENT FOR CONSTRUCTIONS

[75] Inventor: Mario Tringali, Forte Dei Marmi, Italy

[73] Assignee: Coten S.r.l., Milan, Italy

[21] Appl. No.: 368,176

[22] Filed: Apr. 14, 1982

[30] Foreign Application Priority Data

Apr. 30, 1981 [IT] Italy ..... 21465 A/81

[51] Int. Cl.[4] ..... E04B 1/32

[52] U.S. Cl. ..... 52/81; 52/DIG. 10

[58] Field of Search ..... 52/81, 80, 648, DIG. 10, 52/86; 273/153 R, 155, 157 R; 46/25, 29; D25/13, 19

[56] References Cited

U.S. PATENT DOCUMENTS

| | | | |
|---|---|---|---|
| 3,006,670 | 10/1961 | Schmidt | 52/81 |
| 3,018,858 | 1/1962 | Finlayson | 52/81 |
| 3,026,651 | 3/1962 | Richter | 52/81 |
| 3,114,176 | 12/1963 | Miller | 52/81 |
| 3,201,894 | 8/1965 | Resch | 273/157 R |
| 3,392,495 | 7/1968 | Ahern | 52/81 |
| 3,407,558 | 10/1968 | Resch | 52/80 |
| 4,026,078 | 5/1977 | Ahern | 52/81 |

FOREIGN PATENT DOCUMENTS

| | | | |
|---|---|---|---|
| 405398 | 12/1909 | France | 52/81 |
| 1060867 | 3/1967 | United Kingdom | 52/81 |
| 494501 | 5/1975 | U.S.S.R. | 52/80 |

OTHER PUBLICATIONS

Order-In-Space by Critchlow (1972), pp. 62-65.

*Geodesics* by Popko, Aug. 1972, FIG. 1, FIG. 57 of Illustrations.

*Primary Examiner*—John E. Murtagh

*Attorney, Agent, or Firm*—Millen & White

[57] ABSTRACT

This invention relates to a tridimensional structural element which can be composed with similar elements or with other components to obtain constructions, and particularly coverings having low weight and high resistance. In order to obtain the highest possible static resistance, the best working conditions in whatever possible application and the possibility, without the need of any sliding part, of absorbing thermal expansions, the structural element according to the invention comprises a first body having an essentially polygonal plane surface and an even number of sides, i.e., six or more than six, as well as a series of bodies each having an essentially triangular plane surface, which derive towards the outside from alternate sides of the first polygonal body and are on planes forming angles to one another and with respect to the polygonal body plane, in such a way that all the theoretical vertices of the bodies simultaneously touch the surface of a curved surface. The structural element, which results to be "geoconverted", can follow any dimensional condition, either modifying the angles between the plane bodies to vary the radius of the surface as touched by the element vertices, or modifying at will, from zero up to a statically acceptable value, the length of the free sides of the polygonal body.

12 Claims, 24 Drawing Figures

STRUCTURAL ELEMENT FOR CONSTRUCTIONS

BACKGROUND OF THE INVENTION

1. Field of the Invention

This invention concerns a tridimensional structural element, which can be composed of similar elements or other different components to form with them constructions having low weight and high resistance, or a higher resistance with the same weight as compared to prior art constructions. More particularly, this invention relates to a structural element of the above mentioned type, and for the above mentioned applications, which shows particularly advantageous features of high static resistance and low weight, as well as a low manufacturing cost, and which can be used in any way and in any type of construction, but especially to obtain coverings for any kind of area, the supporting parts of which are mainly formed by said structural elements.

2. Description of the Prior Art

The exceptional qualities of static resistance with respect to the low weight of the structural element according to the invention are achieved, as will be seen later on, due to the fact that the element is obtained in a particularly simple and cheap way following the principles of configurations converted to the sphere, according to that particular branch of the construction theory which relates to polygons belonging to the "morphogenetic spheric" field, namely constructions which are as much as possible similar to a spherical configuration, so as to obtain the largest covered volume with the least stress for the supporting structure. The principles of this theory are well know and, of course, are not reported herein. Suffice it to say that, as it has been widely proved, each structural element for constructions results to be the more advantageous, from the viewpoint of the resistance/weight ratio, the more said element is similar to the spherical configuration, or better, to the configuration of a section of spherical surface.

SUMMARY OF THE INVENTION

An object of the present invention is to provide a new structural element as obtained according to the laws of the morphogenetic spherical field and, therefore, with very high resistance/weight ratio which, moreover, shows the advantage of being suitable for any type of construction, both alone or coupled with other elements.

Accordingly, the structural element according to this invention is essentially characterized in that it comprises a first body with an essentially polygonal plane surface, having an even number of sides, six or more, as well as a series of bodies with an essentially triangular plane surface, deriving from alternate sides of the polygonal body and placed in planes forming angles to one another and with respect to the plane of the polygonal body, in such a manner that all the theoretical vertices of the bodies simultaneously touch the surface of a curved surface.

As will be clearly seen further on said structural element, it clearly derives from known solids which "converge" to the spherical forms, one of the more complex of which is the hexapentahedron, from which the known spherical trigonometry derives.

According to one advantageous feature of the present invention, said structural element can be obtained from a plane development, by reciprocal inclination of the bodies forming the same in correspondence of the common sides, the plane development moreover, being advantageously provided with extension bodies connected to the external sides of the main bodies, which can "rotate" with respect to the main bodies, forming with them an angle depending from or defining the angles formed by the planes of the main bodies, the extension bodies being submitted to stress in order that the whole structural element is submitted to a system of tensions which closes in itself and provides the structural element with particular characteristics of resistance and rigidity, allowing it to maintain steadily its spatial configuration, while when the stress or thrust elements are eliminated, the figure tends to return to its original plane condition.

DESCRIPTION OF THE PREFERRED EMBODIMENTS

Figure 1:
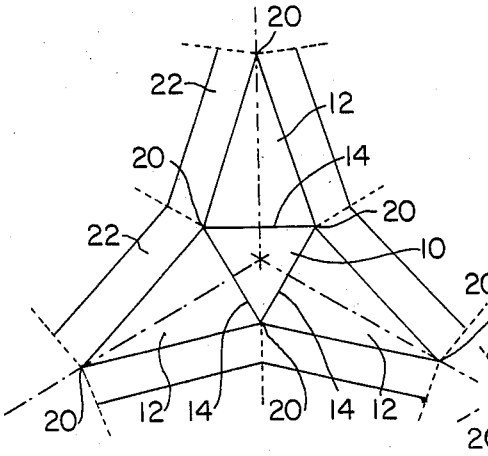
FIGS. 1 to 4 are plan views of plane developments from which structural elements according to the invention can be obtained.

Referring to the drawings, a structural element according to the invention can be obtained from a plane development, by means of suitable connections between the parts forming the same, which are preferably submitted to stress in order to generate a system of stresses inside the structure and thus obtain a so-called "converted to the sphere" structure, having very high stability in shape and very high resistance/weight ratio. The following description will refer to the above mentioned plane developments from which the elements according to the invention derive, but it must be considered that said structural elements can also be obtained directly in their final tridimensional condition and, moreover, that the plane parts of said elements can also be defined even only by simple bars or trestles and by joints connecting said bars. On the other hand, as will be clear those skilled in the art, any type of configuration of the structural element according to the invention, as well as any process for its industrial manufacture, are to be considered within the field of the present invention, obviously provided that the final structural element can be led back to the theoretical structure which will be described starting from the plane configurations of FIGS. 1 to 4.

Figure 2:
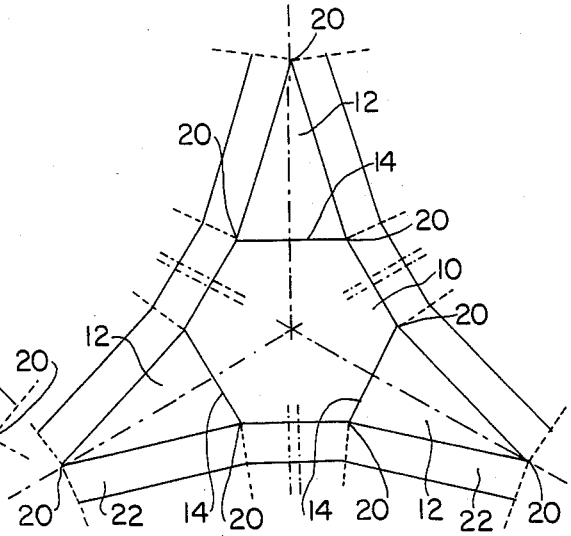
Figure 3:
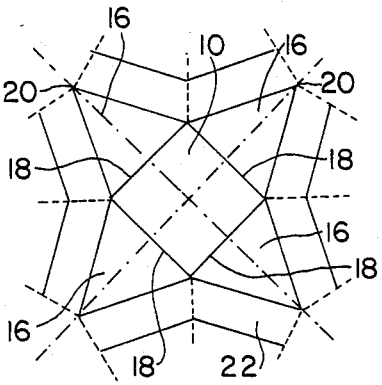

Said plane configurations comprise an essentially polygonal element or body as indicated by 10 in FIGS. from 1 to 4. As it can be seen, the central body 10 is triangular in FIG. 1, hexagonal in FIG. 2, square in FIG. 3 and optagonal in FIG. 4. In the case of FIGS. 1 and 2, three triangular bodies 12, equal to one another, are connected to said body 10; the triangular bodies 12 have one side 14 in common with the central body 10, said triangular bodies 12 being positioned in correspondence with alternate sides of the hexagonal central body 10 as shown in FIG. 2. In the configuration of FIG. 3, four triangular bodies 16, have one side 18 in common with the central body 10, while in the case of FIG. 4 the triangular bodies 16 are still four and have, in common with the central body 10, one side 18 which constitutes one of the alternate sides of the octagon 10. In all cases, the triangular bodies 12 or 16 are formed by isosceles triangles, preferably all equal to one another, while the free sides of the polygons of FIGS. 2 and 4 can have any length ranging between a null value (FIGS. 1 and 3) and any practically acceptable value. The free sides of the hexagon of FIG. 2 will, however, have equal lengths, while the free sides of the octagon of FIG. 4 will have equal lengths two by two. In other words, the opposite and parallel free sides of the octagon of FIG. 4 must be equal.

Generalizing the preceding description and extending it to polygons with a higher number of sides, it is possible to say that this invention comprises those figures in which the central body consists of a polygon with an even number of sides and with free sides which have any length whatever, ranging at will between a null value and any statically acceptable value.

In their tridimensional configuration, where they are part of the structural element according to the invention, the triangular bodies 12 or 16 are positioned on planes forming angles to one another and with respect to the central body 10, so that the theoretical vertices, indicated by the reference 20 in FIGS. 1 to 4 can all be found on the surface of a sphere, or a curved surface and therefore the structural element can be said "converted to the sphere", the diameter of said sphere varying in function of the dimensions of the element sides, and in particular, of the different dimensions applicable to the free sides of the hexagon or of the octagon 10, as well as in function of the reciprocal inclination between the plane bodies 10 and 12 or 10 and 16 respectively. In fact, by rotating the triangles 12 or 16 around the common lines 14 or 18, it is possible to obtain a structural element which deviates from the plane configuration the greater the rotation, the structural element however always remaining "converted to the sphere". In order to maintain said characteristic, in addition to the above mentioned conditions, it is essential that the bisecting lines of the external angles of triangles 12 and 16 meet in a common point, substantially positioned at the center of the central polygon 10. The whole plane development shows a configuration which is similar to that of an equilateral triangle in the case of FIGS. 1 and 2, and to that of a square or a rectangle in the case of FIGS. 3 and 4, the sides showing however a broken-line course with concavity towards outside.

Figure 4:
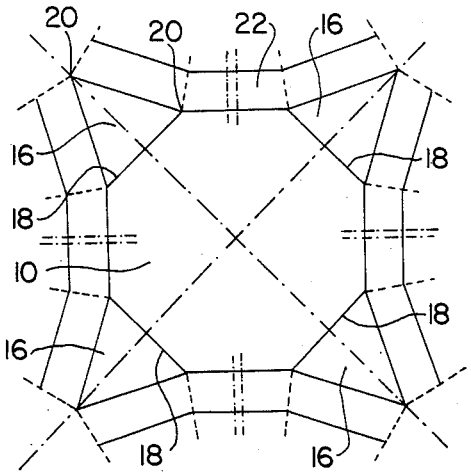

In correspondence with each of the external sides of the triangular bodies 12 and also of the central bodies 10 in the case of FIGS. 2 and 4, there can be extension bodies, generically indicated by 22, which still belong to the plane development and are connected to one another along lines which, in the plane development, can be considered as folding areas, indicated by dash lines in FIGS. 1 to 4. By rotating the extension bodies 22 starting from the figure plane, obviously all on the same side of said plane, it is possible to obtain an automatic disposition of the main bodies in the desired tridimensional condition, as illustrated, for example in FIGS. 5 to 17, the angle between the extension bodies and the main bodies, after this rotation, determining the reciprocal inclination between the main bodies, and therefore, the radius of the sphere to which the structural element results to be converted. The extension bodies, or eventually the triangular bodies only, are connected to one another, on the side opposite to the main bodies, by means of tie bars or other similar means, which create in the whole element a series of internal stresses, which give to the structural element a desired shape rigidity and the best conditions of mechanical resistance.

Figures 5, 6, 7, 8, 9, 10, 11:
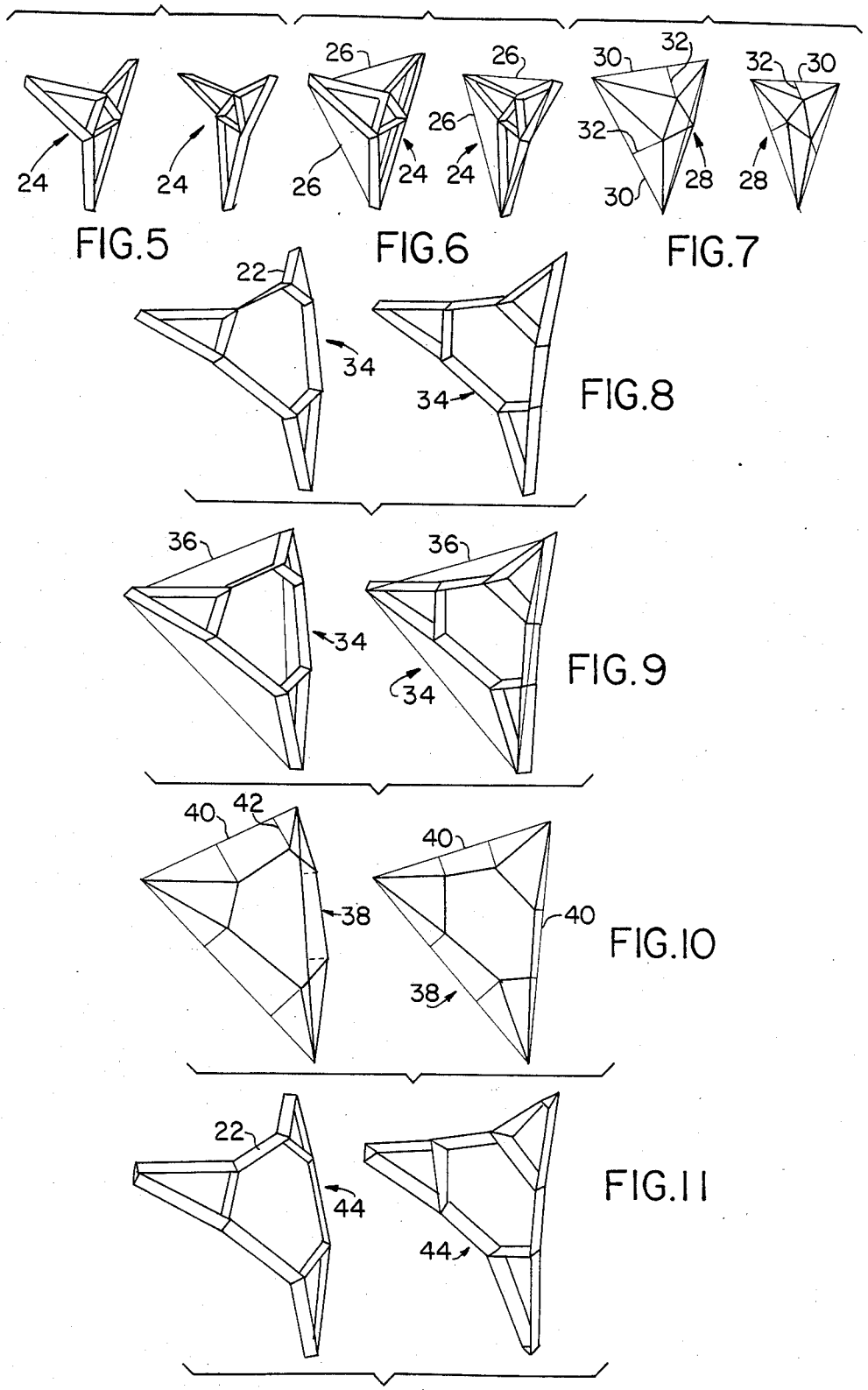
FIGS. 5 to 7 are perspective views, from the outside on the left side and from the inside on the right one, of different possible configurations of a structural element as obtainable from the plane development of FIG. 1, when it is submitted to a stress.
FIGS. 8 to 11 are perspective views similar to those of FIGS. 5 to 7, showing different possible configurations of a structural element, as obtained from the plane development of FIG. 2, when it is submitted to stress.

A diagrammmatic illustration of possible configurations theoretically achievable on the basis of the plane developments of figures from 1 to 4 is shown in FIGS. 5 to 17. FIG. 5 shows a structural element 24 as obtained by rotating the extension bodies 22 of a predetermined angle and by tying said extension bodies to one another so as to create the above mentioned condition of internal stress. The structural element then acquires the configuration perspectively illustrated in FIG. 5, from the external side (on the left) and from the internal side (on the right) respectively. In FIG. 6, the structural element 24 of the preceding FIG. 5 is provided with external tie elements 26, preferably in the form of cables, which cooperate to create and maintain said condition of internal stresses, together with the tridimensional shape of the structure. Finally, FIG. 7 shows another element 28, still derived from the plane development of FIG. 1, where the extension bodies are not present, while the tie elements 30 are directly connected to the vertices of the triangular bodies 12, the structural element being eventually completed by struts 32 which cooperate to its stability.

Parallel to the configurations of FIGS. 5 to 7, it is possible to foresee configurations as obtained from the plane development of FIG. 2 and illustrated in FIGS. 8 to 11. The configuration 34 of FIG. 8 corresponds to that of FIG. 5; tie elements 36 can be applied as indicated in FIG. 9. On the other hand, it is possible to provide for a configuration 38 wherein the extension bodies 22 are eliminated and tie elements 40 are applied at the ends of the triangular bodies 12, together with reinforcing struts 42, which derive from the vertices of the central body 10 (see FIG. 10). The configuration 44 as illustrated in FIG. 11 corresponds to that illustrated in FIG. 8, but wherein the rotation angle of the extension bodies 22 has been limited so that the structural element as obtained results to be more "open" and namely converted to a sphere having a higher radius.

Figure 12:
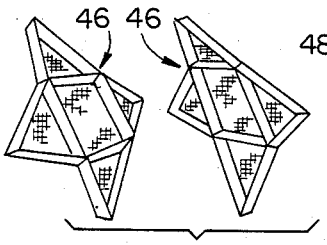
FIGS. 12, 13 and 14 are perspective views, similar to those of the preceding figures, showing structural elements as obtainable from the plane development of FIG. 3.
Figure 13:
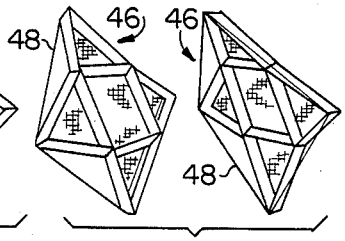
Figure 14:
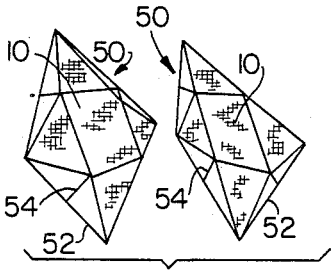

FIG. 12 illustrates a structural element 46 as obtainable by the plane development of FIG. 3, still in the same two perspective views as shown in the preceding figures. Said structural element 46 also, can be provided with tie elements 48 as indicated in FIG. 13.

Still from the plane development of FIG. 4, it is possible to obtain a configuration 50 where tie elements 52 are connected to the free vertices of the triangular bodies 16, thus eliminating the extension bodies 22 and in this case adding struts 54 in correspondence with the vertices of the central body 10.

Figure 15:
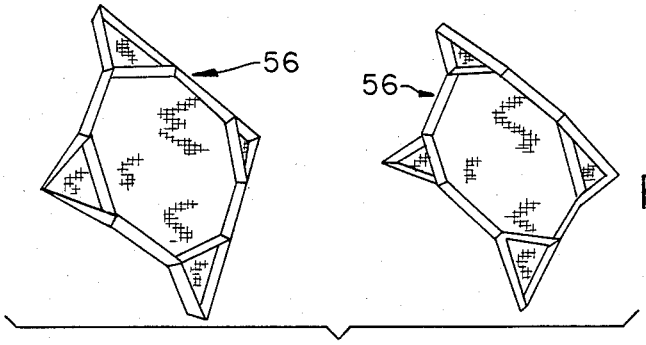
FIGS. 15, 16 and 17 are perspective views, similar to the preceding ones, showing structural elements as obtainable from the plane development of FIG. 4.
Figure 16:
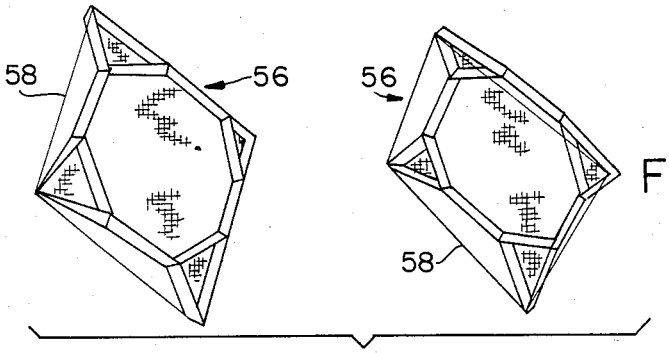
Figure 17:
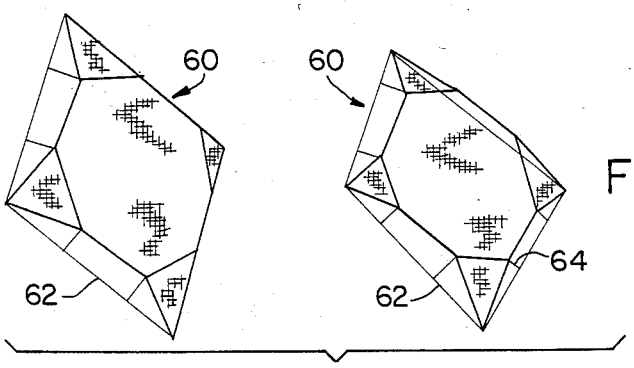

FIG. 15 illustrates a structural element derived from the plane development of FIG. 4 and indicated by 56 in the same figure. The structural element 56 can be equipped with tie elements 58 as shown in FIG. 16, while the embodiment 60 of FIG. 17 still derives from the plane development of FIG. 4 and foresees the elimination of the extension bodies 22, the use of tie elements 62 on the outside, between the free vertices of the triangular bodies 16, as well as the use of struts 64 in correspondence with the vertices of the central body 10. It must be noticed that the essentially quadrangular embodiments of FIGS. 12 to 17 are particularly suitable for horizontal or sub-horizontal elements for support or covering, such as slabs or the like, while the structural elements as illustrated in FIGS. 5 to 11 are particularly suitable for forming vertical or sub-vertical structural elements, such as pillars or the like.

It must be noticed that, in any case, the described structural elements substantially maintain their shape under any stress, being however liable to deformations in order to follow eventual thermal dilations, without modifying their working conditions and always showing the best ratio between mechanical resistance and weight, due to the fact of being "geoconverted" elements. Structural elements can be actually obtained from box-type elements, also defining the surface of the main bodies and eventually of the extension bodies, or from beams which are placed in correspondence of the edges of the different bodies and with joints placed at the vertices between said edges, the surfaces being then formed by covering elements which do not usually perform any loadbearing function. Also the configuration details of the ends of the triangular bodies and of the extension bodies areas can vary in function of the foreseen particular applications and of the coupling with other building elements, equal or different, as well as with bases to rest on the ground.

Figure 18:
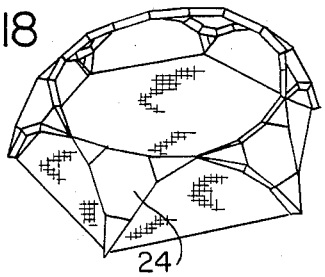
FIGS. 18 to 24 are diagrammatic views of some possible structural elements according to the invention.

FIGS. 18 to 24 illustrate some possible examples of application of structural elements according to the invention, for instance as illustrated in FIG. 2. In particular, FIG. 18 illustrates a covering with hexagonal plan, wherein six structural elements 24 are provided, for being connected to one another, in correspondence with the ends of two of their triangular bodies, in a way as to form the bearing structure of the figure, on which a whatever covering can be placed, for instance, a covering of flexible material and obviously impermeable. However, especially in cases when the covering must have characteristics of resistance, it can be constituted or supported by another structural element according to the invention, for example, of the type as indicated in one of the FIGS. 12 to 17.

Figure 19:
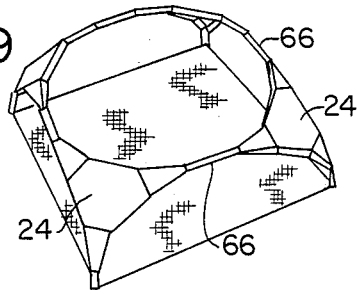
Figure 20:
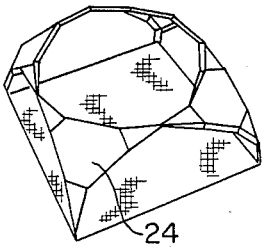

The same manufacturing principles are applied for covering a square surface, as indicated in FIGS. 19 and 20, by means of four structural elements 24 positioned with one of their triangular bodies 12 turned downward and in correspondence with be apexes of the base surface. The other triangular bodies can be directly conncected to one another, as in FIG. 20, or by means of rods 66 completing the upper perimeter of the covering. Obviously said rods can be eliminated and substituted by another geoconverted angular element, according to building needs.

Figure 21:
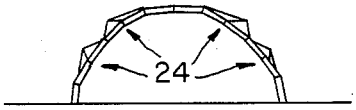
Figure 22:
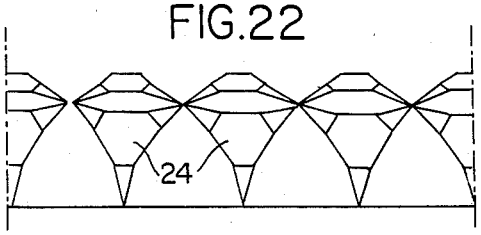
Figure 23:
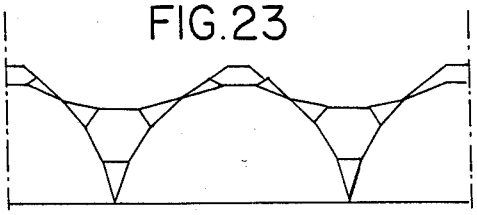

FIGS. 21 and 22 illustrate a configuration for covering a shed, in which the structural elements according to the invention, still indicated by 24, are positioned according to four parallel rows and assembled in a position inclined to one another so as to create a dome-like supporting structure as indicated in FIG. 21. When a lower resistance is required, the structural elements 24 can be alternately placed as indicated in FIG. 23, still forming the bearing structure of a shed covering.

Figure 24:
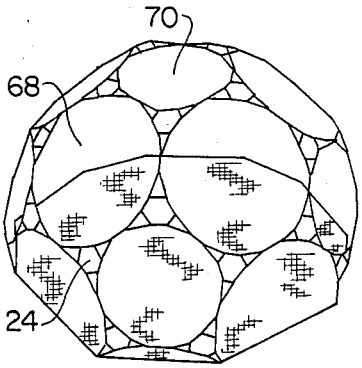

Finally, FIG. 24 illustrates a covering of hemispheric type, consisting of a series of elements derived from the hexagon, in this particular case elements 68 consisting of 24-sided polygons, and elements 70 derived from the pentagon, in this particular case polygons formed by twenty sides or didecagons.

The connecting elements between the para-hexagons and para-pentagons are constituted by structural elements according to the present invention, as it can be clearly noticed in FIG. 24. In particular, the hemispherical covering can show only structural elements 24 as bearing elements, while para-hexagons and para-pentagons are simple openings provided with non-bearing covering elements, preferably flexible covering elements. This figure clearly shows how the structural elements according to the invention are really derived from a sphere-shaped structure and therefore, comply with the rules and features of the above mentioned theory.

As previously mentioned, the structural element according to the invention, and consequently the constructions using said structural elements, can be used in many different ways, chosen time by time according to the desired applications and relevant needs. All these possible different configurations must be considered as coming within the scope of the present invention.

I claim:

1. A three dimensional structure comprising a plurality of like structural elements connected to one another to make up said structure, wherein each element comprises:

a central planar region shaped as one of a hexagon or a triangle the perimeter of the region being defined by the structural elements and the region being covered by a covering element;

three planar triangular shaped, extensions from said central planar region, similarly shaped and spaced from each other on said central planar region by equal distances, the perimeter of each extension defining an area enclosed by the structural elements and covered by the covering elements; said extensions being shaped as isosceles triangles, each having a vertex remote from the central planar region and a base connected to a respective side of the central planar region, each extension being rotated from a plane defined by said central region about the base thereof through an equal angle, said triangular shaped extensions being located such that a bisecting line extending from the the vertices of the extensions extend to meet at a common point at the center of said central planar region;

and wherein the structure comprises:

a plurality of said central planar regions and a plurality of said triangular extensions with all of said triangular extensions being rotated in the same direction away from the plane defined by said central planar regions and with the vertices of the triangular extensions touching the surface of an imaginary sphere;

tie elements interconnecting the vertices of said extensions of each element for creating and maintaining in the respective elements internal stresses providing said elements with a predetermined shape and mechanical resistance, whereby by means of the tie elements structural elements are held in a three dimensional shape; and means for connecting said elements to each other, only at the vertices thereof in configuring said structure.

2. A structure as in claim 1 wherein the central planar region is shaped as a hexagon and wherein the structure further, comprises: quadrangular extension bodies extending from the sides of said central region from which said three triangular extensions do not extend and being connected to the vertices of said three triangular extensions said quandrangular extension bodies being inclined at an angle from both the plane of the central region and the planes of the three triangular extensions to which the bodies are connected and being maintained under stress to create and maintain said elements in three dimensional shape.

3. A structure as in claim 2 wherein said quadrangular bodies are connected to one another in each element by means of tie elements.

4. A structure as in claim 3 wherein said tie elements are cables.

5. A structure as in claim 1 wherein said tie elements are cables.

6. A structure as in claim 2 wherein said tie elements are cables.

7. A structure as in claim 1 wherein said three triangular extensions of each element are interconnected by three tie elements under tension.

8. A structure as in claim 1 further including means for resiliently connecting said extensions to said central planar region, whereby when said tie elements are removed, said extensions tend to return to a coplanar position with said central planar region.

9. A three dimensional structure comprising a plurality of like structural elements connected to one another to make up said structure, wherein each element comprises:

a central planar region shaped as one of a hexagon or a triangle the perimeter of the region being defined by the structural elements and the region being covered by a covering element;

three triangular shaped planar extensions from said central planar region, shaped and spaced from each other on said central planar region by equal distances, the perimeter of each extension defining an area enclosed by the structural elements and covered by the covering elements; said extensions being shaped as isosceles triangles, each having a vertex remote from the central planar region and a base connected to a respective side of the central planar region, each extension being rotated from a plane defined by said central region about the base thereof through an equal angle, said triangular shaped extensions being located such that a bisecting line extending from the the vertices of the extensions extend to meet at a common point at the center of said central planar region;

and wherein a plurality of said central planar regions and a plurality of said triangular extensions with all of said triangular extensions being rotated in the same direction away from the plane defined by said central planar regions and with the vertices of the triangular extensions touching the surface of an imaginary sphere;

tie elements interconnecting the vertices of said extensions of each element for creating and maintaining in the respective elements internal stresses providing said elements with a predetermined shape and mechanical resistance, whereby by means of the tie elements of structural elements are held in a three dimensional shape;

said structure being further characterized by said structural elements being interconnected with each only at their respective vertices to make up said structure, a plurality of said structural elements being interconnected as load bearing components with coplanar ends thereof interconnected by means of rods for forming the pillars of an essentially curved surface, said plurality of said structural elements being positioned in two rows of parallel alignments interconnected to each other at the ends of said triangular extensions to form said supporting pillars, and the covering elements being supported by said supporting pillars in an interconnected manner to define an approximately spherically shaped, shed-like structure.

10. A structure as in claim 9 wherein said tie elements are cables.

11. A structure as in claim 9 wherein said three triangular extensions of each element are interconnected by three tie elements under tension.

12. A structure as in claim 9 further including means for resiliently connecting said extensions to said central planar region, whereby when said tie elements are removed, said extensions tend to return to a coplanar position with said central planar region.

* * * * *